US010266322B2

(12) United States Patent
Hauck

(10) Patent No.: US 10,266,322 B2
(45) Date of Patent: Apr. 23, 2019

(54) CLOSURE CAP FOR A CONTAINER

(71) Applicant: Incap International Ltd., Hong Kong (CN)

(72) Inventor: Axel Hauck, Kirchentellinsfurt (DE)

(73) Assignee: Incap International Ltd., Hong Kong (CN)

( * ) Notice: Subject to any disclaimer, the term of this patent is extended or adjusted under 35 U.S.C. 154(b) by 0 days.

(21) Appl. No.: 15/672,739

(22) Filed: Aug. 9, 2017

(65) Prior Publication Data

US 2019/0031411 A1 Jan. 31, 2019

(30) Foreign Application Priority Data

Jul. 25, 2017 (EP) ..... 17182979

(51) Int. Cl.
*B65D 51/28* (2006.01)

(52) U.S. Cl.
CPC ..... *B65D 51/2835* (2013.01); *B65D 51/2857* (2013.01); *B65D 2101/0076* (2013.01)

(58) Field of Classification Search
CPC . B65D 51/24–51/2835; B65D 51/2857; B65D 2101/0076
USPC ..... 215/295–297, 247, 249, 44, 214, 218, 215/201, 329
See application file for complete search history.

(56) References Cited

U.S. PATENT DOCUMENTS 3,225,970 A * 12/1965 Rooney ..... B65D 47/06 215/44
3,860,133 A * 1/1975 Boxer ..... B65D 50/061 215/206
3,944,102 A * 3/1976 Grau ..... B65D 50/041 215/251
3,945,525 A * 3/1976 Jones ..... B65D 41/32 215/232
4,335,823 A * 6/1982 Montgomery ..... B65D 50/048 215/206
4,402,415 A * 9/1983 Hopley ..... B65D 1/0238 215/256
4,779,749 A * 10/1988 Geiger ..... B65D 41/0478 215/295

(Continued)

FOREIGN PATENT DOCUMENTS

WO WO 2014/023818 A1 2/2014 ..... B65D 51/28
WO WO-2014/023818 A1 2/2014

OTHER PUBLICATIONS

Extended European Search Report issued in corresponding European Patent Application No. 17182979.9 dated Jan. 8, 2018.

*Primary Examiner* — Kareen K Thomas
(74) *Attorney, Agent, or Firm* — Kusner & Jaffe

(57) ABSTRACT

A closure cap for a container, said closure cap having a cap housing which includes a substantially cylindrical recess having a top opening and a bottom opening, a plunger having a cover and a substantially cylindrical lateral surface that engages in the top opening of the recess of the cap housing, and a chamber defined by the recess of the cap housing and the plunger which engages in the recess by way of its lateral surface. The plunger and cap housing being movable relative to one another between (i) a first, non-active position, in which a bottom edge of the lateral surface is arranged above the bottom opening and (ii) a second, activated position, in which the bottom edge of the lateral surface opens the bottom opening.

16 Claims, 4 Drawing Sheets

(56) References Cited

U.S. PATENT DOCUMENTS

| | | | | | |
|---|---|---|---|---|---|
| 4,884,705 | A * | 12/1989 | Debetencourt | B65D 47/242 | 215/250 |
| 5,203,838 | A * | 4/1993 | Schneider | B65D 51/222 | 215/235 |
| 5,547,091 | A * | 8/1996 | Neveras | B65D 35/14 | 215/237 |
| 6,170,654 | B1 * | 1/2001 | Gartner | B65D 51/2828 | 206/219 |
| 8,646,634 | B2 * | 2/2014 | Essebaggers | B65D 47/248 | 215/297 |
| 8,701,906 | B1 * | 4/2014 | Anderson | B65D 41/20 | 206/220 |
| 2004/0020797 | A1 * | 2/2004 | Fontana | A61J 1/2093 | 206/219 |
| 2009/0236303 | A1 * | 9/2009 | Lizerbram | B65D 47/243 | 215/227 |
| 2014/0203043 | A1 | 7/2014 | Yamanaka | | |
| 2016/0362236 | A1 | 12/2016 | Mühlemann | | |

* cited by examiner

CLOSURE CAP FOR A CONTAINER

FIELD OF INVENTION

The present invention relates to a closure cap for a container and to a container provided with a closure cap of this type. The invention relates, in particular, to a closure cap for a container, which closure cap, in its interior, has a chamber in which a substance, for example an active substance, is kept separated from the rest of the interior of the container and, when required, in particular directly prior to use, is able to be discharged into the interior of the container. The closure cap can be used with a vast variety of containers, including bottles, drinking glasses, bowls, beakers, tumblers and the like.

BACKGROUND OF INVENTION

A plurality of substances, for example medicines or food additives such as vitamins, proteins, anti-oxidants or even vegetable additives, as an aqueous solution, aqueous suspension or emulsion have a potency that decreases rapidly with time. In particular in the area of sport and wellbeing, these types of products are preferably commercialised in liquid form, often in pre-packaged beverage bottles. As a result of the unavoidable transport and storage times, in the majority of cases these types of beverages no longer provide the consumer with the originally desired effect or only provide it in a limited manner. Many of the above-described substances, however, maintain their initial properties very well in dried form, for example as capsules, pastilles, tablets, pills, granulate or powder without forfeiting their original potency. Consequently there are already beverage containers on the market which have at least two separate chambers, one chamber containing the liquid and the other chamber containing the actual active substance in dried form or as a concentrated liquid or paste. Not until directly prior to use are the contents of the two chambers mixed and the beverage consumed. In the case of a variant of these types of beverage bottles, the substance, which is typically dried or is present in concentrated form, is situated in a chamber provided in the closure cap, whilst the liquid which makes up the main proportion of the beverage is situated in a conventional manner in the main container.

Applicant's international patent application WO 2014/023818 describes a closure cap for a container, said closure cap having an inner chamber in which a substance to be protected is able to be kept protected from environmental influences during storage and prior to use is able to be discharged into a container where the closure cap is provided with a clear and easily understandable activating mechanism and which can be produced in a particularly simple and cost-efficient manner.

The closure cap of WO 2014/023818 comprises a cap housing which includes a substantially cylindrical recess which has a top opening and a bottom opening, wherein the bottom opening is closed by means of a membrane, a plunger which comprises a cover and a substantially cylindrical lateral surface which extends downward from an underside of the cover, wherein the lateral surface engages in the top opening of the recess of the cap housing and has an outside diameter which corresponds substantially to the inside diameter of the recess, and a chamber which is defined by the recess of the cap housing and the plunger which engages in the recess by way of its lateral surface, the plunger and the cap housing being arranged so as to be movable relative to one another between a first, non-active position, in which a bottom edge of the lateral surface is arranged above the bottom opening of the recess of the cap housing and a second, activated position, in which the bottom edge of the lateral surface opens the initially closed bottom opening.

In the embodiment of WO 2014/023818, the opening of the bottom opening can be effected by providing the bottom rim of the plunger with a sharpened edge or at least a tip or point which is able to pierce the membrane when the plunger is moved into the second, activated position. In order to be easily piercable, the membrane has to be relatively thin and therefore lacks structural rigidity to allow for a large opening at the bottom of the cap to be formed, preferably an opening which essentially corresponds to the bottom opening of the recess. If, however, the membrane is provided with enough structural rigidity, the forces required for piercing he membrane increase and handling of the closure cap becomes more and more difficult. While a small opening will generally be sufficient to discharge a liquid, discharging of powders or granulate or other larger materials will generally require a larger opening which is reliably formed upon activation of the closure cap. Specifically, for medical applications, where reliable dosing of the substance contained in the closure cap is required, it is important to provide an opening which allows essentially complete discharge of the substance contained in the closure cap.

SUMMARY OF INVENTION

It is therefore a technical problem of the present invention to improve the closure cap described in WO 2014/023818 in such a manner that a large opening can reliably be formed in the bottom of the closure cap upon its activation. Moreover, the components of the closure cap should maintain their structural integrity upon activation and forming of the opening so that no pieces of the membrane or of the plunger are discharged into the container.

Said technical problem is solved by the closure cap according to the accompanying independent claim(s). Advantageous further developments of the invention are the objects of the dependent claims.

Accordingly, the invention relates to a closure cap for a container as described in Applicant's international patent application WO 2014/023818 and which is characterized in that the cap housing is provided with a bottom plate arranged in the bottom opening of the cylindrical recess and hingedly connected to the cylindrical recess, the membrane being arranged beneath the bottom plate and being sealingly connected to a bottom rim of the cylindrical recess.

Accordingly, in contrast to WO 2014/023818, where the bottom of the closure cap is merely provided with a membrane which has to accomplish both the sealing and the opening functionality, the present invention suggests to provide two components at the bottom of the closure cap, where the additional component suggested by the invention, i.e. the bottom plate, is specifically directed to improving the opening functionality and does not have to exhibit any sealing functionality.

As the bottom plate does not have to be pierced, it can be made more rigid to improve the opening functionality without having any detrimental effect on the forces required to open the closure cap upon activation.

Rather, it is preferred according to one embodiment of the invention that the bottom plate has a smaller surface area than the area of the bottom opening of the cylindrical recess so that a gap is provided between the bottom of the cylindrical recess and the bottom plate along most of the inner circumference of the bottom opening. The term "most" has to be understood in the sense that a gap between the bottom plate and the cylindrical recess is provided on more than 50%, preferably more than 75% of the inner circumference of the bottom opening. On a smaller portion of the inner circumference, the bottom plate is hingedly fixed to the cylindrical recess.

In a preferred embodiment, the bottom plate comprises a connection segment connected at its circumference to the cylindrical recess, a rotatable segment which exhibits the gap at its circumference, i.e. which is not connected to the cylindrical recess, and a line of reduced thickness between the connection segment and the rotatable segment which establishes a hinged connection between the segments. Accordingly, upon activation of the closure cap, the connection segment of the bottom plate essentially remains unchanged while the rotatable segment rotates outward due to the action of the plunger on the rotatable segment.

According to one embodiment, the membrane is glued or welded to the bottom rim of the cylindrical recess.

The bottom plate is preferably arranged in such a manner that a movement of the plunger from the first, non-active position to the second, active position rotates the rotatable segment of the bottom plate outward in order to peel the membrane off the bottom rim of the cylindrical recess. In this manner, the membrane remains undestroyed while the movement of the rigid bottom plate allows for a large opening to be formed at the bottom of the recess by peeling the membrane off the rim and moving the membrane as a whole away from the opening. Moreover, in this embodiment, there is no danger that any pieces of the membrane will fall into the container provided with the closure cap of the invention.

In another embodiment, the plunger is provided with a sharpened edge or point such that a movement of the plunger from the first, non-active position to the second, active position pierces the membrane and subsequently rotates the rotatable segment of the bottom plate outward in order to tear the membrane open. The bottom plate thus increases the size of the opening beyond the size which would be accomplished by merely piercing the membrane. In this embodiment, the membrane will be torn open essentially along the rim of the recess and/or peeled off the rim as described above.

In case of a piercing of the membrane, it is preferred that the gap between the bottom plate and the recess is enlarged in the region where the point or edge pierces the membrane.

In one embodiment of the present invention, the bottom plate is integrally moulded with the cap housing. For instance, the cap housing and the bottom plate can form an injection-moulded piece made from a plastic material.

The membrane can also be made from a plastic material. It is, however, preferred that the membrane is a metal foil, for instance an aluminium foil.

According to a preferred embodiment of the invention, the activation mechanism of the closure cap corresponds to the activation mechanism described in Applicant's WO 2014/023818. Accordingly, in the first non-active position, the plunger is blocked from being vertically pressed into the recess of the cap housing and the plunger is movable by means of an essentially rotational movement from the first, non-active position into an intermediate position where the plunger is allowed to be pressed into the recess so as to reach the second, activated position. The plunger is movable from the intermediate position into the second, activated position by means of a translational movement, for instance by pressing the plunger downwards, or by a combined rotational and translational movement, for instance a screw-type movement, with reference to the cap housing. The plunger has a skirt with a bottom edge with abuts at least in part against a top edge of an outer sleeve of the cap housing, the bottom edge of the skirt and the top edge of the outer sleeve being profiled in such a manner that a rotation of the plunger enables the translational movement of the plunger into the recess of the cap housing.

Preferably, the bottom edge of the skirt of the plunger has a nose which abuts against a raised edge of the top edge of the outer sleeve in the first, non-active position and engages in an indentation formed by the top edge of the outer sleeve in the second, activated position.

The closure cap according to the invention can be connected to the container in a diverse manner. In the case of a container where the bottle neck thereof has an external thread, the cap housing can have an internal thread, for example, for fastening the closure cap on the container in a detachable manner.

Once the closure cap has been activated, the substance located in the interior of the chamber being discharged into the interior of the container and being mixed with the liquid located there, the closure cap is consequently able to be unscrewed totally from the container such that the resultant mixture, for example the vitamin drink or the like, is able to be consumed. A ribbing, a rubber coating or a wrinkling of the surface, for example, can be provided on the outside of the cap housing in order to make it easier to unscrew the closure cap from the container.

According to a preferred variant, the cap housing of the closure cap is connected to a locking ring by means of several thin webs in order to ensure the integrity of the container. When unscrewing the closure cap from the container, the webs are broken and the locking ring is fixed on the bottle neck in such a manner that it remains on the container. When the closure cap is screwed on again, the breached webs are then also an indication that the container is no longer in the intact original state.

There are no limits to the types of substances which are able to be filled into the chamber of the closure cap. In a particularly preferred manner, however, the closure cap according to the invention is used for beverage bottles such that the substance can be a health-promoting active substance, for example.

In a particularly preferred manner, the cap housing and the plunger are each realized as an integral moulded part, e.g. by injection moulding, such that the closure cap is able to be produced in a particularly favourable manner.

The invention also relates to a container which is provided with a closure cap according to the invention of the above-mentioned type. The closure cap of the invention can be used with a variety of containers such as bottles, drinking glasses, bowls, beakers, tumblers, jars, tubes and the like. A variety means for attaching the cap to the container with sufficient security can be used, including threads, lugs, hinges, locks, adhesives, etc. In those cases where a removable closure cap is required, thread caps will usually be preferred. The closure cap can have an internal thread for cooperating with the usual external thread of bottles. In some cases, the cap may have an external thread for cooperating with an internal thread of a drinking glass or tumbler. In this variant, the drinking glass or tumbler presents a smooth outer rim once the closure cap is removed.

The closure cap of the invention can be made from a variety of materials, preferably from a plastic material. The closure cap can exhibit a certain flexibility to adjust to slight manufacturing variation in the container and the closure structure and to maintain a liquid and/or gas tight seal. In addition or alternatively, the cap can be provided with gaskets such as O-rings or closure liners to provide for the seal.

The invention is explained below in more detail by way of exemplary embodiments shown in the accompanying drawings.

DETAILED DESCRIPTION OF THE INVENTION

The activation scheme of the closure cap of the present invention is described in connection with FIGS. 1 to 6 which show a closure cap as described in applicant's international patent application WO 2014/023818 which employs a similar activation scheme.

Figure 1:
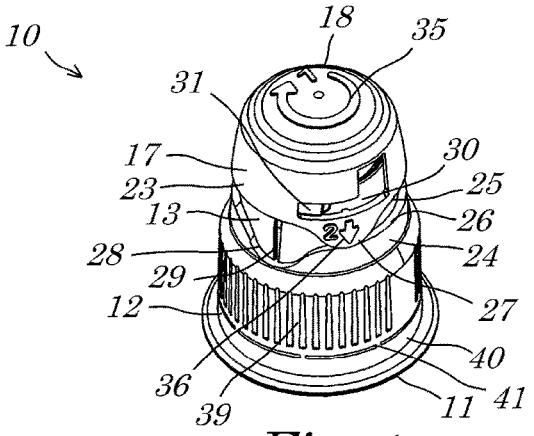
FIG. 1 shows a perspective view of the closure cap described in WO 2014/023818 in the first, non-active position (storage position)
Figure 2:
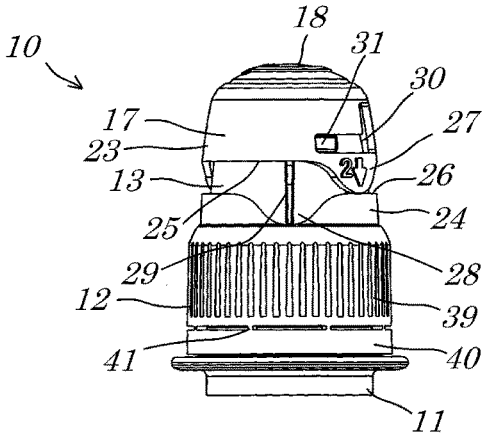
FIG. 2 shows a side view of the closure cap of FIG. 1 in the first, non-active position.
Figure 3:
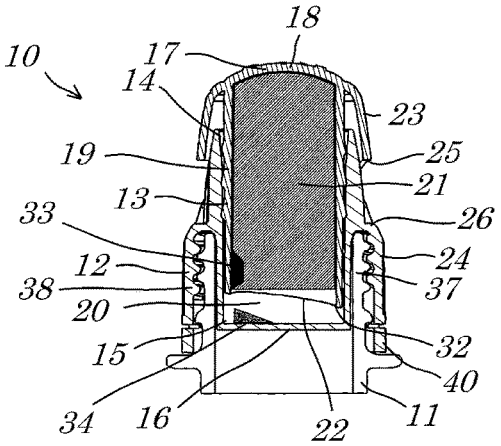
FIG. 3 shows a cross section through the closure cap of FIG. 1 in the first, non-active position.

The closure cap of WO 2014/023818 is shown in the first, non-active position in FIGS. 1 to 3.

The closure cap, designated overall by the reference numeral 10, is fastened on a bottle neck 11 of a container, which for reasons of better clarity is not shown any further. The closure cap 10 includes a cap housing 12 which has a substantially cylindrical recess 13 which has a top opening 14 and a bottom opening 15. The bottom opening 15 is closed by means of a piercable membrane 16 such that the recess 13 is realised overall in a U-shaped manner. A plunger 17, which includes a cover 18 and a cylindrical lateral surface 19 which extends downward from the underside of the cover 18, is inserted into the recess 13. The lateral surface 19 engages in the top opening 14 of the recess 13. As can be seen in particular from the cross sectional representation in FIG. 3, the outside diameter of the lateral surface 19 corresponds substantially to the inside diameter of the cylindrical recess 13, such that the lateral surface 19 abuts closely against the inside wall of the recess 13. The cylindrical lateral surface 19 and the cover 18 of the plunger are essentially in the form of an inverted U. The plunger which engages in the recess of the cap housing and the recess of the cap housing consequently form a closed chamber 20, in which a substance 21 is located. The plunger 17 and the cap housing 12 are movable toward one another in a rotational and translational manner such that the plunger 17 is able to be moved from the first, non-active position shown in FIGS. 1 to 3 into the second, activated position shown in FIGS. 4 to 6. In the first, non-active position, the bottom edge 22 of the lateral surface 19 is situated above the membrane 16 such that the chamber 20 is closed.

To ensure the rotational and translational movement, the plunger 17 has a skirt 23 which essentially is an downward extension of the cover 18. The cap housing 12 also has an outer sleeve 24 which surrounds the recess 13 over part of its height. The bottom edge 25 of the skirt 23 and the top edge 26 of the outer sleeve 24 are profiled such that in the first, non-active position shown in FIGS. 1 to 3 the plunger 17 is not able to be pressed downward into the interior of the cap housing such that there is no risk of piercing the membrane 16. Rathermore, the plunger has first to be rotated so that the plunger 17 is able to be pressed downward into the cap housing 12. To this end, in the example shown, the skirt 23 has a nose 27 which abuts against the raised edge of the top edge 26 of the outer sleeve 24 in the first, non-active position. Once the plunger 17 has been rotated, the nose 27 can be pressed downward into an indentation 28 which is formed by the top edge 27 of the outer sleeve 24. So that the user notices how far he has to rotate the plunger 17, a vertically extending groove 29 is provided in the outside wall of the recess 13, into which groove a projection which is provided on the inside surface of the nose 27 is able to engage when the nose is situated above the indentation 28. The projection cannot be seen in the Figures. In addition, in the case of the depicted embodiment of the closure cap according to the invention, an L-shaped guide groove 30 is provided in the skirt 23 into which a guide pin 31 which is provided on the outside wall of the recess 13 engages. The horizontal portion of the L consequently defines the horizontal rotatability of the plunger 17, whilst the vertical portion of the L of the guide groove 30 defines the vertical mobility of the plunger 17. Over and above this, the indentation 28 forms a stop for the nose 27 of the plunger.

The bottom edge 22 of the lateral surface 19 of the plunger 17, as can be seen in particular in FIG. 3, is profiled in such a manner that a point 32 is created which is directed towards the membrane 16. When the plunger 17 is pressed downward, for example by pressing or tapping on the cover 18, the membrane 16 is perforated first of all by the point 32. A wedge-shaped projection 33 is provided on the inside wall of the lateral surface 19 in order to facilitate the folding back of the part-perforated membrane 16. To this effect, when the plunger 17 is pushed downward in the direction of the membrane 16, the wedge-shaped projection 33 interacts in the manner of a lever with a projection 34 which is provided on the top surface of the membrane 16.

As can be seen in particular in FIG. 1, markings 35, 36 (in the present embodiment arrows and numbering to clarify the sequence of rotation and translation) have been applied to the surface of the plunger 17.

To activate the closure cap according to the invention, the plunger 17 is rotated in the direction of the arrow marking 35 (i. e. clockwise) until the projection which is realized on the inside surface of the nose 37 latches into the vertical groove 29. The plunger 17 is then pressed downward by means of pressure or a light tap on the cover 18 so that the bottom edge 22 of the lateral surface 19 is able to pierce the membrane 16. As a result of the profiling of the bottom edge 22, which can be seen in FIG. 3, the membrane on the side opposite the point 32 is not completely severed, but remains connected to the bottom opening 15 of the recess 13. The projections 33 and 34 ensure, however, that the part-perforated membrane is folded back down completely, such that the substance 21 located in the interior of the chamber 20 is able to escape downwardly.

Figure 4:
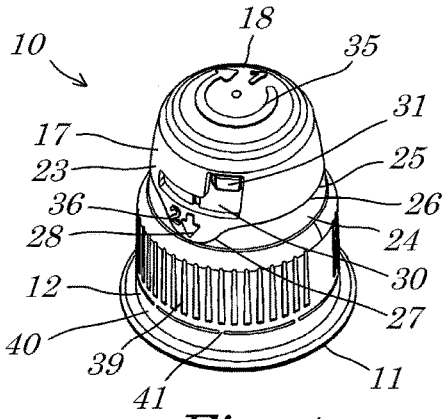
FIG. 4 shows a perspective view corresponding to FIG. 1 of the closure cap described in WO 2014/023818 in the second, activated position.
Figure 5:
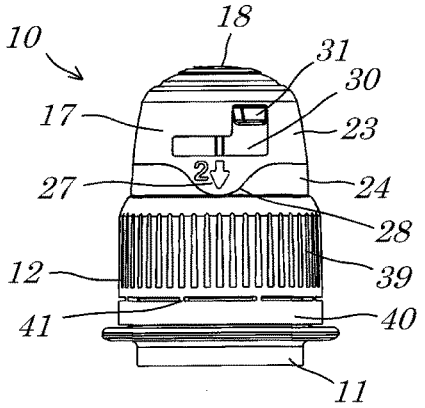
FIG. 5 shows a view corresponding to FIG. 2 of the closure cap described in WO 2014/023818 in the second, activated position.
Figure 6:
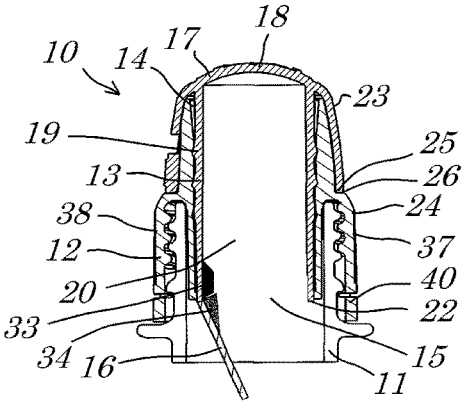
FIG. 6 shows a cross section corresponding to FIG. 3 of the closure cap described in WO 2014/023818 in the second, activated position.

FIGS. 4 to 6 show the closure cap of FIGS. 1 to 3 in the correspondingly activated state. In said state, the nose 27 is situated in the indentation 28 and the guide pin 31 has reached the opposite end of the guide groove 30.

In the example shown, the container neck 11 has an external thread 37. Accordingly, the cap housing 12 is provided with an internal thread 38 for fastening the closure cap 10 on the container neck 11 in a detachable manner. Once the closure cap 10 has been activated, the entire closure cap can consequently be unscrewed from the container neck 11. For this purpose, the outer sleeve 24 of the cap housing 12 has a ribbing 39 which makes it possible to grasp and rotate the closure cap more easily.

In the example shown, the closure cap additionally has a locking ring 40, which is fixed on the container neck 11 and is connected to the cap housing 12 by means of thin webs 41. When the closure cap is unscrewed, the webs 41 break and consequently show that the container is no longer in the original intact state. The locking ring 40, in this case, is non-rotatably connected to the container neck 11.

FIGS. 7-12 show embodiments of the closure cap according to the present invention. Elements which are identical or which essentially correspond to elements already described in connection with the embodiment shown in FIGS. 1-6 are denoted by the same reference signs and will not be described in detail any more.

Figure 7:
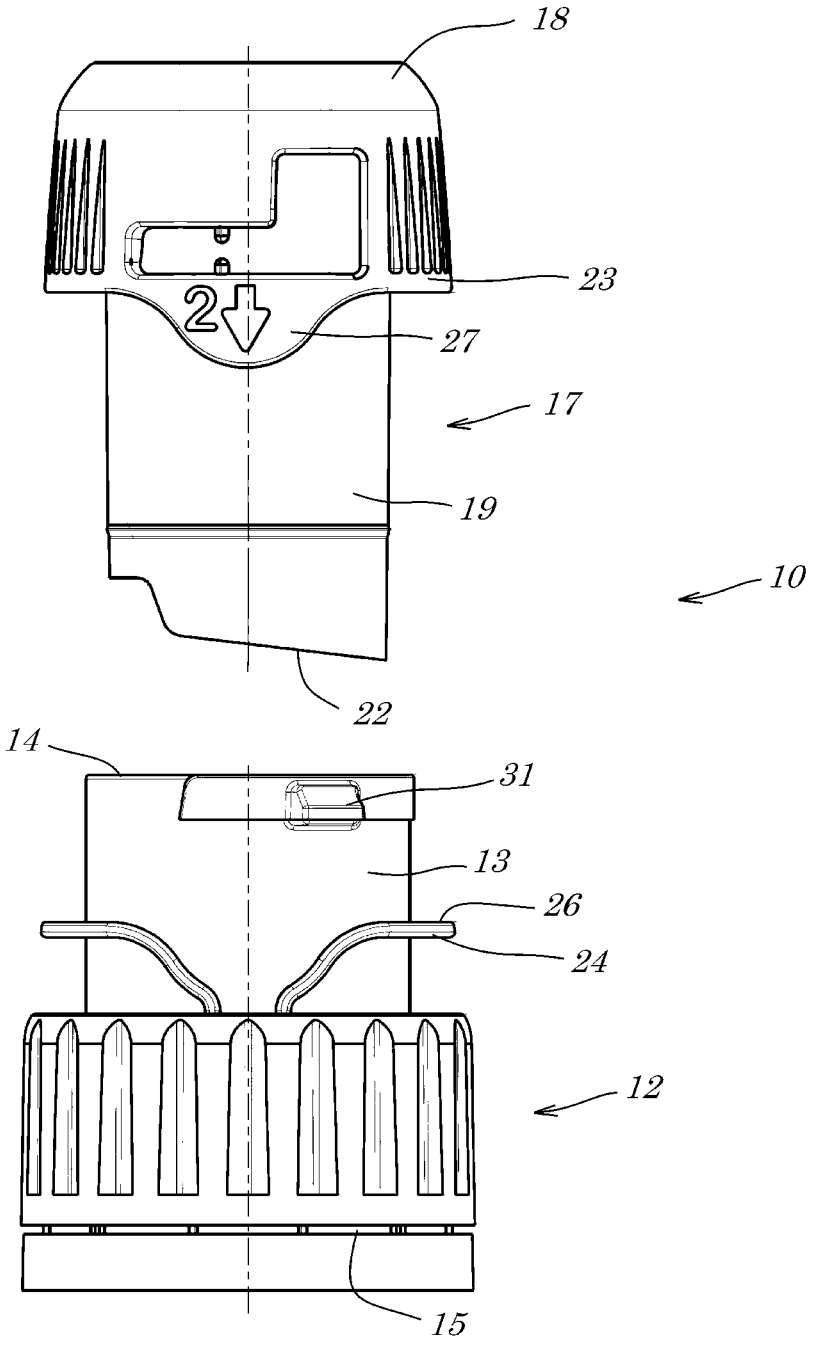
FIG. 7 shows a perspective view of the closure cap according to a first embodiment of the invention in a disassembled state.

FIGS. 7 to 10 depict a first embodiment of the closure cap of the present invention. In FIG. 7, the closure cap 10 is shown as an exploded view, i.e. the cap housing or base 12 and the plunger or dome 17 are shown in a disassembled state before the cylindrical lateral surface 19 of the plunger 17 is inserted into the cylindrical recess 13 of the cap housing 12 via its top opening 14, and before the guide pin 31 of the cap housing/base 12 is inserted into the guide groove 30 of the plunger/dome 17. In this embodiment, in contrast to the embodiment of FIGS. 1-6, the outer sleeve 24 of the cap housing 12 is reduced to a narrow rim provided on the outer surface of the cylindrical recess 13. The top edge 26 of the outer sleeve 24 provides a guiding profile for the nose 27 of the skirt 23 of plunger 17. As can also be taken from FIG. 7, the bottom edge 22 of the lateral surface 19 of plunger 17 is slanted, so that the region at the lowest edge 32 is closest to the bottom opening 15 of recess 13.

Figure 8:
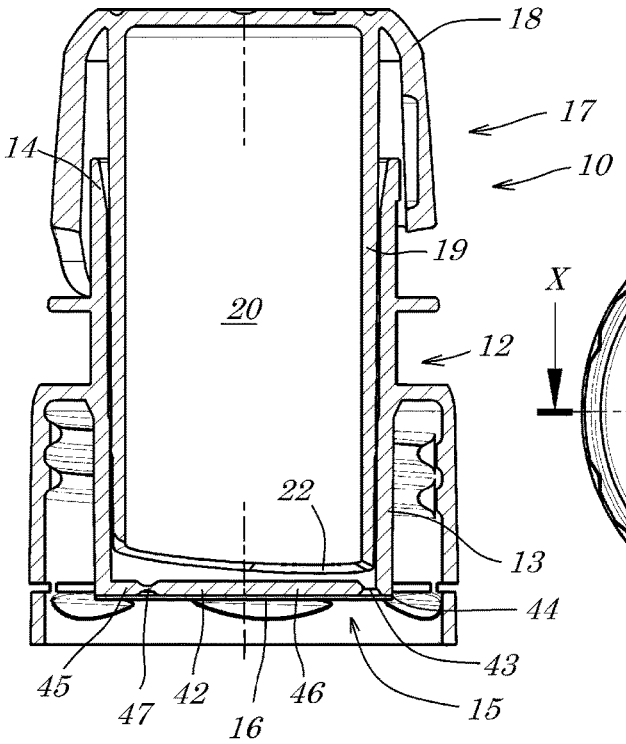
FIG. 8 shows a cross-sectional view of the closure cap of FIG. 7 in an assembled state.

FIG. 8 depicts a cross sectional view of the closure cap 10 of FIG. 7 in an assembled but non-activated state, i.e. before the plunger 17 is completely inserted into the recess 13.

As can be taken from the cross sectional view, similar to the embodiments of FIGS. 1-6, the cylindrical lateral surface 19 of plunger 17 and the recess 13 of cap housing/base 12 form a closed chamber 20, in which a (not depicted) substance can be stored, which will be discharged via the bottom opening 15 of recess 13 into a (not depicted) container which has been provided with the closure cap 10 of the present invention. In the depicted non-activated state, the plunger 17 has not yet been completely inserted into the recess 13 to open the chamber 20 at its bottom.

The cap housing 12 is provided with a bottom plate 42, arranged in the bottom opening 15 of the cap housing. The bottom plate 42 is hingedly connected to the cylindrical recess 13 so that the bottom plate 42 can rotate downward when the bottom edge 22 of the cylindrical lateral surface 19 of plunger 17 presses on the upper side of bottom plate 42 when plunger 17 is fully inserted into recess 13 upon activation of the closure cap 10.

As can be taken from the cross sectional view of FIG. 8, the bottom plate 42 does not fully close the bottom opening 15 of the cylindrical recess 13, and does therefore not seal chamber 20. Rather, the bottom plate 42 has a smaller surface area than the area of bottom opening 15 so that a gap 43 is provided at the bottom opening 15 between the inner surface of cylindrical recess 13 and the outer surface of bottom plate 15 along most part of the inner circumference of bottom opening 15.

In order to seal the bottom opening 15 and consequently chamber 20, a metal foil acting as sealing membrane 16 is provided beneath bottom plate 42. The metal foil/membrane 16 is glued or welded to a bottom rim 44 of recess 13.

In the embodiment of FIGS. 7-10, the hinged connection of the bottom plate 42 to the cylindrical recess 13 is established as follows: Bottom plate 42 comprises a connection segment 45 which is connected at its circumference to the cylindrical recess 13, and a rotatable segment 46 which is not connected to the cylindrical recess 13, but has smaller dimensions than the bottom opening 15 of the cylindrical recess, thus establishing the gap 43 between its outer circumference and the inner circumference of the cylindrical recess 13 at the bottom opening. In the embodiment of FIG. 8, the hinged connection is established by providing a line 47 of reduced thickness between the connection segment 45 and the rotatable segment 46. The line 47 of reduced thickness acts as a hinge allowing the rotatable segment 46 to be rotated downwardly with respect to the connection segment 45 when plunger 17 acts on the rotatable segment 46.

Specifically, when closure cap 10 is activated by fully inserting plunger 17 into recess 13, the bottom edge 22 of the lateral surface 19 of plunger 13 presses on the upper surface of bottom plate 42. Due to the slanted or rounded profile of bottom edge 22, plunger 17 starts pressing on bottom plate 42 at an edge opposite to the hinged connection of bottom plate 42 with cylindrical recess 13, so that bottom plate 42 can rotate downwardly. On its downward rotation, bottom plate 42 peels the metal foil/membrane 16 off bottom rim 44 of the cylindrical recess 13, thus opening the closed chamber 20 at the bottom opening 15 of cylindrical recess 13.

In an embodiment where the base plate 42 is comprised of an essentially immovable connection segment, in addition to being glued or welded to the bottom rim 44 of the recess 13, the membrane/foil 16 can also be glued or welded to the bottom side of connection segment 45.

Figure 9:
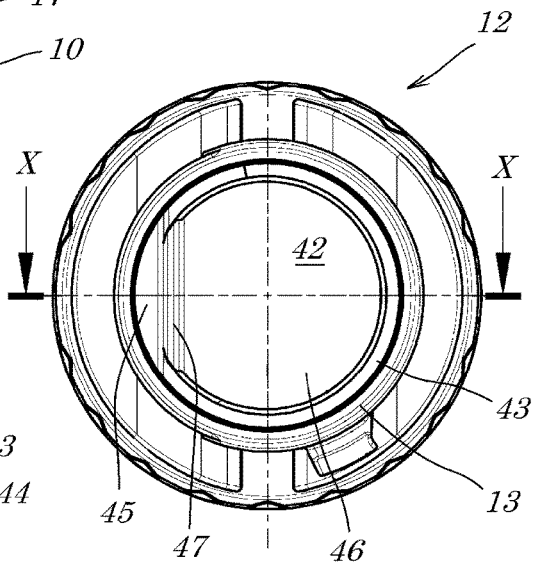
FIG. 9 shows a top view of the base unit of the closure cap of FIG. 7.

In FIG. 9, a top view of the cap housing 12 is depicted, providing a different view on bottom plate 42 comprising the connection section 45 connected to the inner circumference of recess 13 of cap housing 12, and rotatable section 46 being dimensioned such that a gap 43 is established between the outer circumference of the rotatable section 46 and the inner circumference of the cylindrical recess 13.

Figure 10:
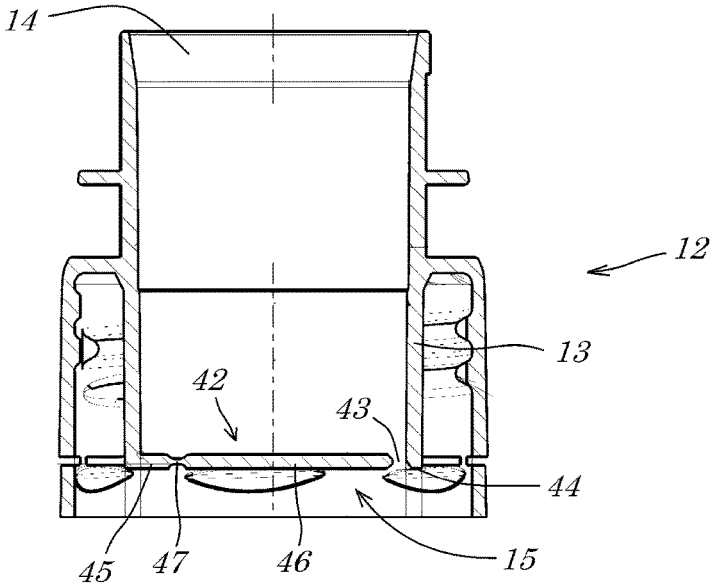
FIG. 10 shows a cross-sectional view of the base unit of the closure cap of FIG. 7 along the line X-X of FIG. 9.

In FIG. 10, a cross sectional view of the cap housing 12 along the line X-X of FIG. 9 is depicted (without metal foil/membrane 16). As can be particularly taken from FIG. 10 in the embodiment of FIGS. 8-10, the cap housing including bottom plate 42 is formed as a single injection-moulded peak made from a plastic material.

Figure 11:
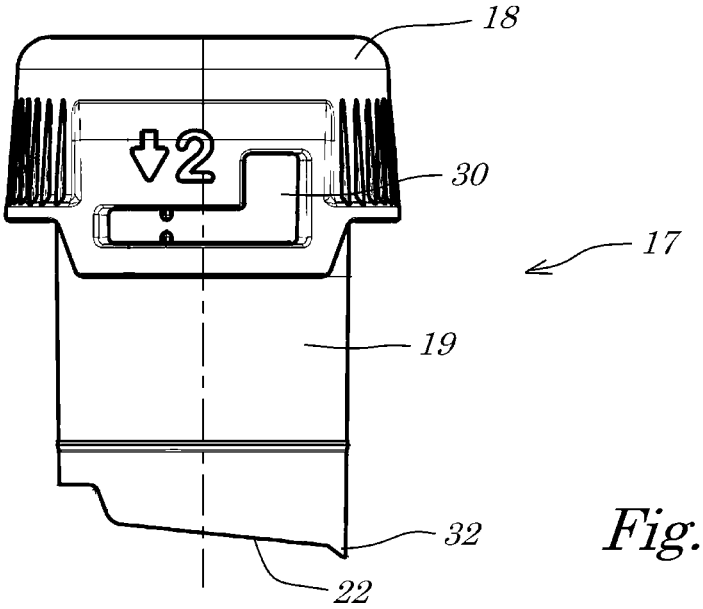
FIG. 11 shows the plunger of a second embodiment of the closure cap of the invention.
Figure 12:
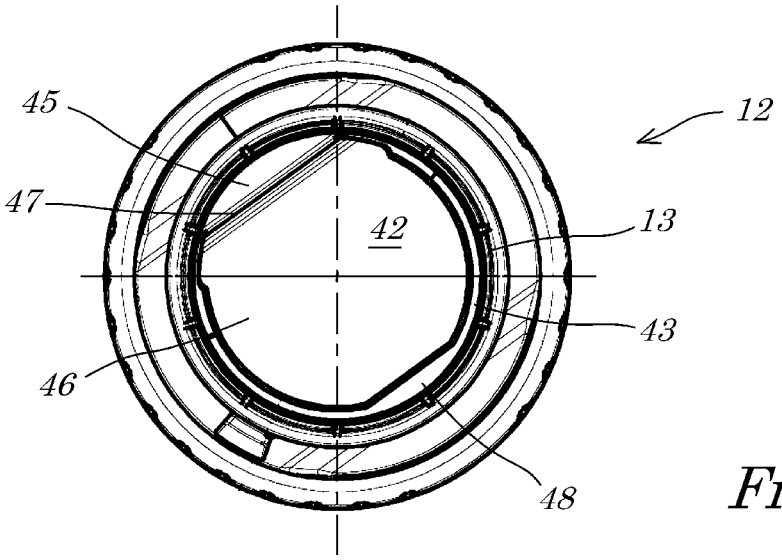
FIG. 12 shows a top view of a base unit of a second embodiment of the invention.

In FIGS. 11 and 12, a second embodiment of the closure cap 10 of the present invention is depicted. FIG. 11 shows a side view of the plunger/dome part 17 of the second embodiment, while FIG. 12 shows a top view of the cap housing 12 of the second embodiment.

The second embodiment differs from the first embodiment in that the bottom edge 22 of lateral surface 19 of plunger 17 is provided with a sharpened tip or point 32, thus allowing the metal foil/membrane 16 to be pierced when the plunger 17 is moved from its first, inactive position into its second activated position, i.e. when plunger 17 is fully inserted into the recess 13 of cap housing 12. In order to allow for an easy piercing of the membrane/foil 16, a segment of the base plate 42 can be cut off providing an enlarged region 48 of gap 43 in the area where the point 32 of bottom edge 22 acts on the membrane/foil 16.

The second embodiment is particularly preferred with larger closure caps, where the bottom rim 44 of the recess 13 has a larger circumference, thus providing an increased resistance to peeling off the metal foil 16. The second embodiment therefore allows to pierce the metal foil 16 allowing the bottom plate 42 to tear the pre-pierced membrane apart without having to peel it completely of the rim.

Having described the invention, the following is claimed:

1. A closure cap for a container, said closure cap comprising:

a cap housing including a substantially cylindrical recess having a top opening and a bottom opening, wherein the bottom opening is closed by means of a membrane, a plunger including a cover and a substantially cylindrical lateral surface which extends downward from an underside of the cover, wherein the lateral surface engages in the top opening of the recess of the cap housing and has an outside diameter which corresponds substantially to an inside diameter of the recess, and a chamber defined by the recess of the cap housing and the plunger which engages in the recess by way of the lateral surface, wherein the plunger and the cap housing are arranged so as to be movable relative to one another between (i) a first, non-active position, in which a bottom edge of the lateral surface is arranged above the bottom opening of the recess of the cap housing and (ii) a second, activated position, in which the bottom edge of the lateral surface opens the bottom opening, and the cap housing is provided with a bottom plate arranged in the bottom opening and hingedly connected to the cylindrical recess, the membrane being arranged beneath the bottom plate and being sealingly connected to a bottom rim of the cylindrical recess.

2. The closure cap according to claim 1, wherein the bottom plate has a smaller surface area than the area of the bottom opening so that a gap is provided between the bottom of the cylindrical recess and the bottom plate along most of the inner circumference of the bottom opening.

3. The closure cap according to claim 2, wherein the bottom plate comprises a connection segment connected at its circumference to the cylindrical recess, a rotatable segment provided with said gap at its circumference, and a line of reduced thickness between the connection segment and the rotatable segment establishing a hinged connection between the segments.

4. The closure cap according to claim 3, wherein the membrane is clued or welded to the bottom rim of the cylindrical recess.

5. The closure cap according to claim 4, wherein the bottom plate is arranged in such a manner that a movement of the plunger from the first, non-active position to the second, active position rotates the rotatable segment of the bottom plate outward in order to peel the membrane off the bottom rim of the cylindrical recess.

6. The closure cap according to claim 3, wherein the plunger is provided with a point such that a movement of the plunger from the first, non-active position to the second, active position pierces the membrane and rotates the rotatable segment of the bottom plate outward in order to tear the membrane open.

7. The closure cap according to claim 6, wherein the gap is enlarged in the region where the point pierces the membrane.

8. The closure cap according to claim 1, wherein the bottom plate is integrally moulded with the cap housing.

9. The closure cap according to claim 8, wherein the cap housing and the bottom plate are an injection-moulded piece made from a plastic material.

10. The closure cap according to claim 1, wherein the membrane is a metal foil.

11. The closure cap according to claim 1, wherein in the first non-active position, the plunger is blocked from being vertically pressed into the recess of the cap housing, and wherein the plunger is movable by means of an essentially rotational movement from the first, non-active position into an intermediate position where the plunger is allowed to be pressed into the recess so as to reach the second, activated position, the plunger being movable from the intermediate position into the second, activated position by means of a translational or a combined rotational and translational movement with reference to the cap housing, the plunger having a skirt with a bottom edge which abuts at least in part against a top edge of an outer sleeve of the cap housing, and the bottom edge of the skirt and the top edge of the outer sleeve being profiled in such a manner that a rotation of the plunger enables the translational movement of the plunger into the recess of the cap housing.

12. The closure cap according to claim 11, wherein the bottom edge of the skirt of the plunger has a nose which abuts against a raised edge of the top edge of the outer sleeve in the first, non-active position and engages in an indentation formed by the top edge of the outer sleeve in the second, activated position.

13. The closure cap according to claim 1, wherein the chamber is filled with a substance.

14. The closure cap according to claim 1, wherein the cap housing and the plunger are each realized as an integral moulded part.

15. A container having a closure cap according to claim 1.

16. The closure cap according to claim 13, wherein the substance is an active substance.

* * * * *